US005640988A

United States Patent [19]

Brereton

[11] Patent Number: 5,640,988

[45] Date of Patent: Jun. 24, 1997

[54] VORTEX VALVES

[75] Inventor: Roy Brereton, Clevedon, United Kingdom

[73] Assignee: Hydro International plc, Clevedon, United Kingdom

[21] Appl. No.: 403,822

[22] PCT Filed: Sep. 23, 1993

[86] PCT No.: PCT/GB93/02001

§ 371 Date: Mar. 14, 1995

§ 102(e) Date: Mar. 14, 1995

[87] PCT Pub. No.: WO94/08146

PCT Pub. Date: Apr. 14, 1994

[30] Foreign Application Priority Data

Oct. 6, 1992 [GB] United Kingdom ..... 9221017

[51] Int. Cl.[6] ..... F17D 1/18; F15C 1/16

[52] U.S. Cl. ..... 137/14; 137/810; 137/813; 251/294; 251/300

[58] Field of Search ..... 137/810, 813, 137/14, 1; 251/294, 300

[56] References Cited

U.S. PATENT DOCUMENTS 3,612,093 10/1971 Gramse ..... 251/300

4,889,166 12/1989 Lakatos ..... 137/810

FOREIGN PATENT DOCUMENTS 15230 1/1902 Sweden ..... 251/300

*Primary Examiner*—A. Michael Chambers

*Attorney, Agent, or Firm*—Larson and Taylor

[57] ABSTRACT

A vortex valve (40) includes a housing defining a votex chamber(44), the housing having an inlet (46) through which liquid may enter the vortex chamber (44)in a manner to promote swirl within the vortex chamber (44) and an outlet (30) at one axial end of the vortex chamber (44). A wall of the housing is provided with an opening which is normally closed by a closure, this closure (6) being operable between the closed position and an open position in which livid may enter the vortex chamber (44) by-passing the inlet (46). The vortex valve is free from a spring device capable of urging the closure (6) from the open position to the close position. The vortex valve (40) may be provided at the outlet of a gully and is useful in enabling a blockage, which may occur at the inlet (46) of the vortex valve (40), to be by-passed, thereby draining any accumulated liquid in the gully. The blockage may then be removed when the gully is relatively dry.

8 Claims, 3 Drawing Sheets

FIG. 3
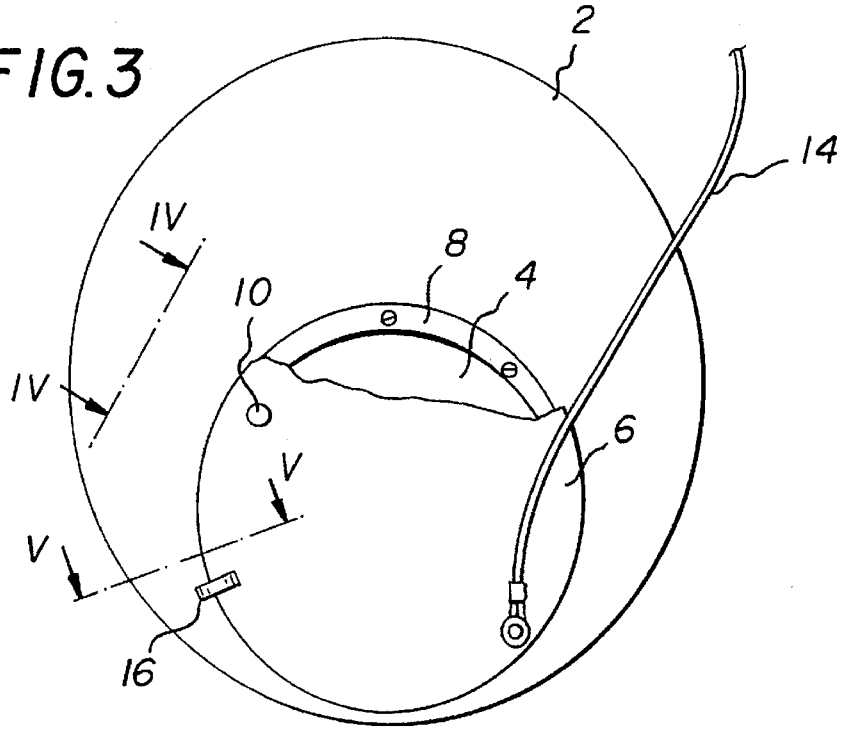
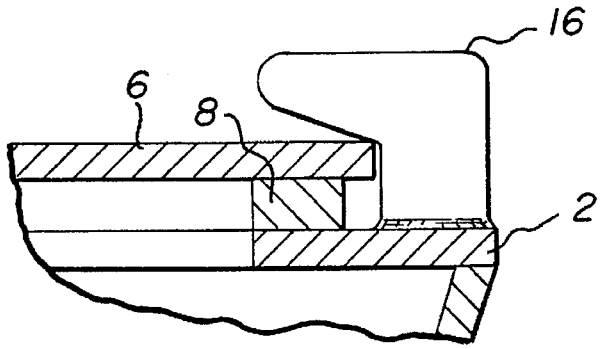
FIG. 5
FIG. 4
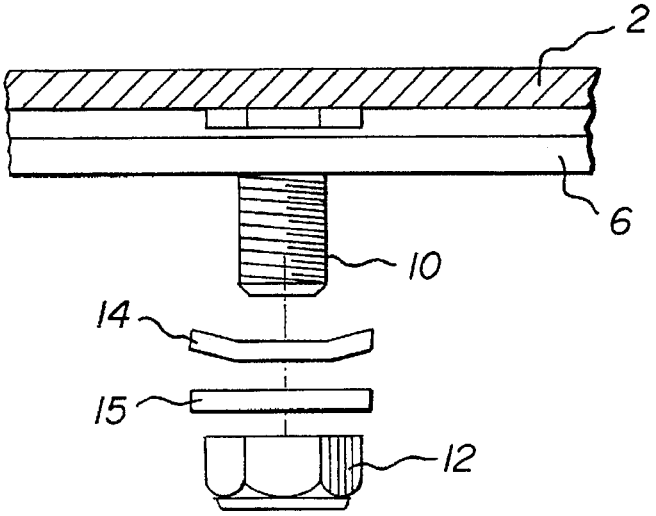

VORTEX VALVES

This invention relates to vortex valves and is more particularly concerned with a vortex valve including a means by which the inlet to the valve may be by-passed.

GB-A-22210995 (and equivalent documents US-A-4889166 and EP-A-0312271) describes a vortex-valve comprising a housing defining a vortex chamber, the housing having an inlet through which liquid may enter the vortex chamber in a manner to promote swirl within the vortex chamber and an outlet at one axial end of the vortex chamber, a wall of the housing being provided with an opening normally closed by a closure, wherein said closure is operable between the closed position and an open position, in which open position liquid may enter the vortex chamber by-passing said inlet, by means remote from the vortex-valve. The closure is held in the normally closed position by a spring which tends to urge the closure against a stop; the spring therefore ensures that once a blockage has been cleared, the closure returns to its normally closed position. When installed incorrectly, the spring of this prior art arrangement may occassionally collect rags making opening of the by-pass door more difficult; the present invention seeks to overcome this problem.

According to a first aspect of the present invention there is provided a vortex valve comprising a housing defining a vortex chamber, the housing having an inlet through which liquid may enter the vortex chamber in a manner to promote swirl within the vortex chamber and an outlet at one axial end of the vortex chamber, a wall of the housing being provided with an opening normally closed by a closure, wherein said closure is operable between the closed position and an open position, in which open position liquid may enter the vortex chamber by-passing said inlet, by means remote from the vortex-valve, characterized in that the said vortex valve is free from spring means capable of urging the closure from the open position to the closed position.

The vortex valve may be provided at the outlet of a gully and, according to a second aspect of the present invention there is provided a gully having an outlet which communicates with the interior of the gully through a vortex valve, said vortex valve comprising a housing defining a vortex chamber, the vortex chamber communicating with the gully through an inlet through which liquid may enter the vortex chamber in a manner to promote swirl within the vortex chamber, an outlet being provided at one axial end of the vortex chamber and a wall of the housing being provided with an opening normally closed by a closure, wherein said closure is operable between the closed position and an open position, in which open position liquid may enter the vortex chamber from the gully by-passing the liquid inlet, by means remote from the vortex-valve, characterized in that the said vortex valve is free from spring means capable of urging the closure from the open position to the closed position.

When a blockage occurs at the inlet of the vortex valve, and water builds up in the gully in which the vortex valve is situated, the closure is moved by the said means remote from the vortex valve (either manually or automatically) to the open position, permitting the flooded gully to empty, the liquid in the gully by-passing the inlet. Once the gully is empty, the vortex valve is readily accessible and the inlet easily cleaned. Moreover, the operator cleaning the blockage can manually close the closure before leaving the gully.

The vortex valve is preferably free from any mechanical means capable of urging the closure from the open position to the closed position without direct manual intervention.

Preferably, the closure is able to pivot about an axis to move between the closed and open positions. In one embodiment, the wall of the vortex valve provided with the opening has a shaft means projecting outwardly which is secured to the closure in a manner such that the closure can rotate about the shaft. In this embodiment, the closure may be provided with an aperture through which the said shaft passes, the closure additionally being restrained from substantial axial movement on the shaft; for instance the shaft may be threaded and a nut may be employed to secure the closure to the wall. A spring washer may also be provided on the shaft to bias the closure towards the wall slightly.

It is not essential to provide an elaborate sealing means between the closure and the housing as the liquid head in the gully and the weight of the door will normally be sufficient to press the closure tightly against the housing. When the gully is dry or substantially dry, the vortex valve is in a "dormant" state and the presence of a pressure head of liquid in the gully to press the closure tightly against the housing is not required.

As indicated, the closure is operable between the closed position and the open position by means remote from the vortex valve. Thus, for instance, a cord may be attached to the closure, the cord leading out of the gully in which the valve is situated, for remote opening of the closure.

Alternatively, a waterproof electrical actuator may be provided, responsive to a signal generated remotely, to open the closure.

Although the term "gully" is often used to mean a road gully, its intended meaning herein is broad and covers any liquid collection region or liquid interceptor through which liquid may flow.

According to a third aspect of the present invention, there is provided a method of unblocking a blocked vortex valve situated at the outlet of a flooded gully, said vortex valve comprising a housing defining a vortex chamber, the housing having an inlet communicating with the gully through which liquid may enter the vortex chamber in a manner to promote swirl within the vortex chamber and an outlet at one axial end of the vortex chamber, a wall of the housing being provided with an opening normally closed by a closure and said closure being operable between the closed position and an open position in which liquid may enter the vortex chamber from the gully by-passing the liquid inlet the said vortex valve being free from spring means capable of urging the closure from the open position to the closed position; said method comprising:

(i) operating the closure from the normally closed position to the open position by a means remote from the vortex valve;

(ii) permitting the flooded gully to drain through the opening in the housing and the gully outlet;

(iii) removing any material blocking the vortex valve; and (iv) returning the closure to the closed position.

For a better understanding of the present invention, and to show how the same may be carried into effect, reference will now be made, by way of example only, to the accompanying drawings in which:

FIG. 3 shows a wall of the housing of a vortex valve in accordance with the first aspect of the present invention;

FIG. 4 is a section on the line IV—IV of FIG. 3;

FIG. 5 is a section on the line V—V of FIG. 3;

Figure 1:
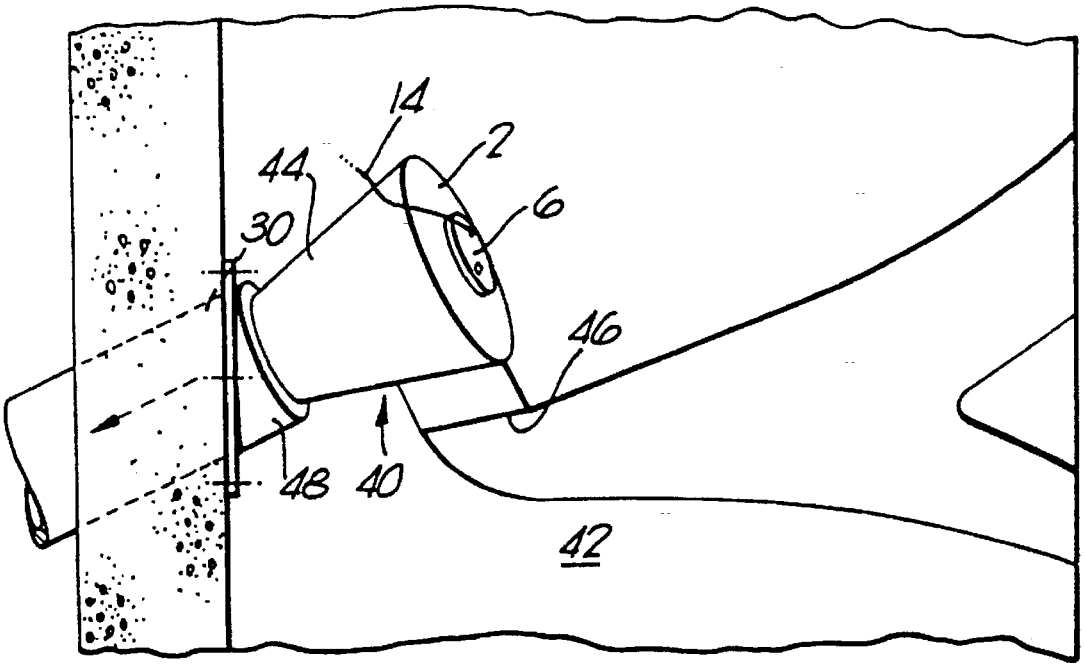
FIG. 1 is a plan view of part of a gully provided with a vortex valve.
Figure 2:
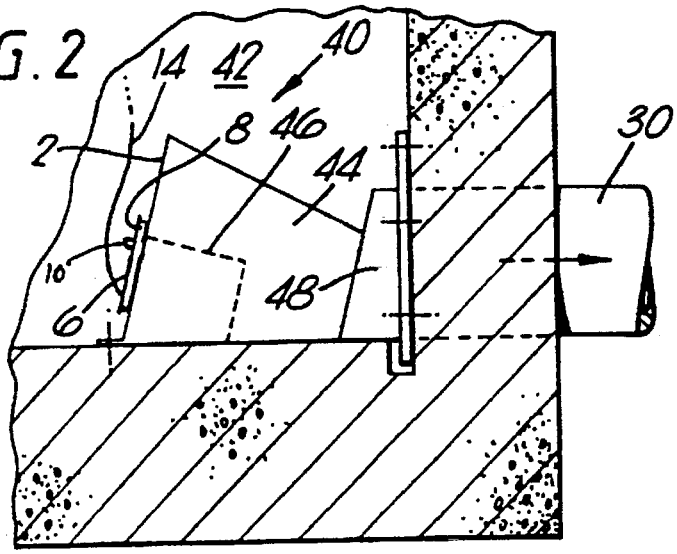
FIG. 2 is a section through the gully shown in FIG. 1.

FIGS. 1 and 2 show a vortex valve 40 in accordance with the present invention, in situ in a gully 42. The vortex valve 40 comprises a conical vortex chamber 44 having an inlet 46 and an outlet 48. The outlet 48 communicates with an outlet 30 of the gully. The end wall 2 of the valve 40 is provided with a by-pass mechanism of the type shown in FIGS. 3 to 5. Normally, the closure 6 is closed over the opening (not shown). A cord 14 attached to the closure 6 leads to a position remote from the vortex valve 40 and gully 42 where the opening and closing of the closure 6 can be controlled from an accessible position. Any water in the gully 42 enters the inlet 46 to the vortex chamber 44, passes through the vortex chamber and out of the outlet 48 thereof. During storm conditions, the rate of flow through the vortex valve 40 is sufficiently high to cause the liquid in the vortex chamber to swirl, which swirl will cause a braking effect on the flow of water through the valve 40. This will cause a build up of water in the gully 42. Thus, in storm conditions, the rate of flow of water out of the gully 42 is controlled. Should the vortex valve 40 become blocked during storm conditions, for example, by debris present in the gully which becomes trapped in the inlet 46 of valve 40, the water backs up in the gully 42 and, under extreme conditions, will flood out of the top of the gully 42. The vortex valve 40 may be unblocked by first pulling the cord 14 thereby moving the closure 6 to a position in which the opening is open. This permits water in the gully 42 to flow unimpeded through the vortex chamber 44 and out of the outlet 30, and the gully 42 soon drains. Once the gully 22 has drained, an operator can, if necessary, descend into the empty gully and unblock the vortex valve 40. Occasionally, however, it is not necessary for the vortex valve 40 to be cleaned manually as the action of the water flushing through the vortex chamber 44 may be sufficient to clean out the vortex valve.

In FIGS. 3, 4 and 5, a detail of a wall 2 of the housing of a vortex valve in accordance with the present invention is shown. The wall 2 shown is circular (FIG. 1), and might, for instance, be the end wall of a vortex valve such as that shown in FIGS. 1 and 2. The wall 2 of the housing is provided with a combined opening 4 and closure member 6. Associated with the closure member 6 is an annular sealing member 8 to seal between the closure and the wall 2, a cable 14 attached to the closure and a retaining lug 16 to assist in retaining the closure in the closed position during normal operation and to act as stop to provide positive location of the closure 6. The opening 4 is normally closed by the closure 6 with the annular seal 8 spacing apart the closure 6 and the wall 2 around the opening 8. The closure 6 is able to pivot about a threaded shaft 10 projecting outwardly from the wall 2 of the vortex valve. The closure 6 is therefore provided with an opening to receive the shaft 10 and is mounted such that the closure 6 can rotate about the shaft 10. The closure 6 is restrained from substantial axial movement on the shaft 10 by a nut 12. A spring washer 14 and a plain washer 15 are also provided on the shaft; the spring washer 14 biases the closure towards the wall slightly. The closure 6 pivots about the shaft 10 between a position (as shown) in which the closure 6 closes the opening 4 and an open position (not shown) in which the closure 6 is pivoted away from the opening 4. The closure 6 may be opened by pulling on the cable 14 causing the closure 6 to escape the capture of the retaining lug 16 and to be pulled away from the opening 4. When the opening 4 is open, liquid may flow directly into the vortex chamber thereby by-passing the normal inlet and destroying the swirl in the vortex chamber. The closure 6 may be returned manually to the closed position once the cable 14 has been released.

Figure 6:
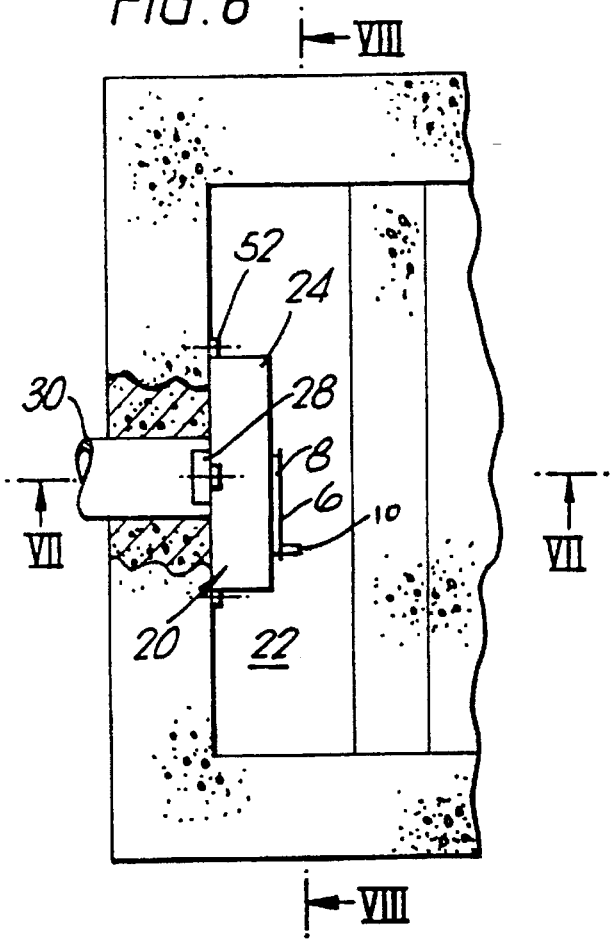
FIG. 6 is a plan view of another embodiment of a gully provided with a vortex valve.
Figure 7:
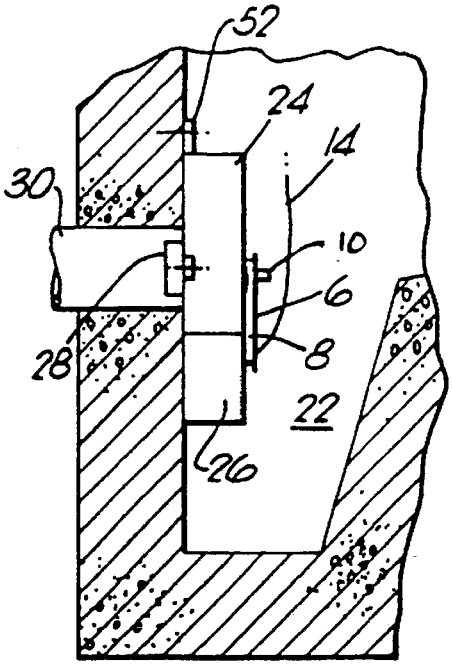
FIG. 7 is a section on the line VII—VII of FIG. 6.
Figure 8:
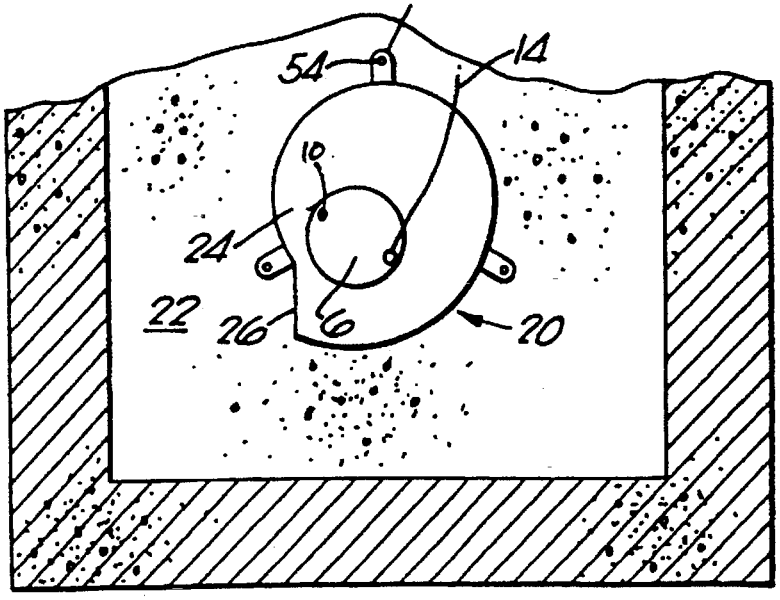
FIG. 8 is a section on the line VIII—VIII of FIG. 6.

FIGS. 6, 7 and 8 show a combination of a gully 22 and vortex valve 20 similar to that shown in FIGS. 1 and 2. In the embodiment shown in FIGS. 6, 7 and 8, however, the vortex valve 20 has a cylindrical vortex chamber 24, rather than the conical chamber 44, as shown in FIGS. 1 and 2. The principle of operation of the combined gully and vortex valve 20 shown in FIGS. 1 and 2 is, nevertheless, substantially identical to the manner of operation of the valve 40 shown in FIGS. 1 and 2. As before, the return of the closure to the closed position is not achieved by any mechanical element associated with the vortex valve. Instead the operator servicing the valve will be able to close the closure manually.

I claim:

1. A method of unblocking a blocked vortex valve situated at an outlet of a flooded gully, said vortex valve comprising (a) a housing defining a vortex chamber, the housing having an inlet communicating with the gully through which liquid may enter the vortex chamber in a manner to promote swirl within the vortex chamber, an outlet at one axial end of the vortex chamber, a wall, and an opening in the wall; (b) a closure which normally closes the opening (c) a mounting means for mounting said closure for mechanical biasing free operation between a closed position and an open position in which open position liquid may enter the vortex chamber from the gully by-passing the inlet, and (d) an opening means remote from the vortex valve for moving said closure from the closed to the open position free from mechanical bias urging the closure from the open position to the closed position; said method comprising the steps of:

(i) operating the closure from the normally closed position to the open position by the opening means remote from the vortex valve;

(ii) permitting the flooded gully to drain through the opening in the housing and the gully outlet;

(iii) removing any material blocking the vortex valve; and (iv) returning the closure to the closed position.

2. A vortex valve comprising a housing defining a vortex chamber, the housing having an inlet through which liquid may enter the vortex chamber in a manner to promote swirl within the vortex chamber an outlet at one axial end of the vortex chamber, a wall, and an opening in the wall;

a closure which normally closes the opening, a mounting means for mounting said closure for mechanical biasing free operation between a closed position and an open position, in which open position liquid may enter the vortex chamber by-passing said inlet an opening means remote from the vortex valve for moving said closure from the closed to the open position free from mechanical bias urging the closure from the open position to the closed position.

3. A vortex valve according to claim 2, wherein said mounting means includes an axis about which the closure is able to pivot to move between the closed and open positions.

4. A vortex valve according to claim 3, wherein said mounting means includes a shaft projecting outwardly from said wall and a securing device by which the closure is secured to the shaft in a manner such that the closure can rotate about the shaft.

5. A vortex valve according to claim 3, wherein the closure is provided with an aperture through which said shaft freely passes, and wherein said securing device restrains the closure from substantial axial movement on the shaft.

6. A vortex valve according to claim 5, wherein a spring washer is provided on the shaft between the securing device and the closure to bias the closure towards the wall.

7. A gully comprising:

an interior, an outlet, and a vortex valve through which said outlet communicates with the interior, said vortex valve comprising a housing defining a vortex chamber, an inlet through which the vortex chamber communicates with the gully and through which liquid may enter the vortex chamber in a manner to promote swirl within the vortex chamber, an outlet provided at one axial end of the vortex chamber, a wall, an opening in the wall;

a closure which normally closes the opening, a mounting means for mounting said closure for mechanical biasing free operation between a closed position and an open position, in which open position liquid may enter the vortex chamber from the gully by-passing the liquid inlet;

an opening means remote from the vortex valve for moving said closure from the closed to the open position free from mechanical bias urging the closure from the open position to the closed position.

8. A gully according to claim 7, wherein a cable is attached to the closure, the cable leading out of the gully in which the vortex valve is situated, for remote opening of the closure.

* * * * *